US007934558B2

(12) United States Patent
Hales et al.

(10) Patent No.: US 7,934,558 B2
(45) Date of Patent: May 3, 2011

(54) SYSTEM AND METHOD FOR DYNAMICALLY ADJUSTING THE CENTER OF GRAVITY OF A PERFORATING APPARATUS

(75) Inventors: John H. Hales, Frisco, TX (US); Allison E. Novak, Wylie, TX (US); John D. Burleson, Denton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 145 days.

(21) Appl. No.: 12/403,420

(22) Filed: Mar. 13, 2009

(65) Prior Publication Data

US 2010/0230163 A1 Sep. 16, 2010

(51) Int. Cl.

| | |
|---|---|
| ***E21B 29/00*** | (2006.01) |
| ***E21B 29/10*** | (2006.01) |
| ***E21B 43/11*** | (2006.01) |
| ***E03B 3/11*** | (2006.01) |
| ***F42D 3/00*** | (2006.01) |
| ***G21J 3/02*** | (2006.01) |

(52) U.S. Cl. ..... 166/297; 166/50; 166/55.1; 175/4.6

(58) Field of Classification Search ..... 166/297, 166/50, 55.1; 175/4.6

See application file for complete search history.

(56) References Cited

U.S. PATENT DOCUMENTS

| | | | | |
|---|---|---|---|---|
| 4,194,577 | A * | 3/1980 | Vann | 175/4.51 |
| 4,269,278 | A * | 5/1981 | Vann | 175/4.51 |
| 4,410,051 | A | 10/1983 | Daniel et al. | |
| 4,438,810 | A | 3/1984 | Wilkinson | |
| 4,523,649 | A * | 6/1985 | Stout | 175/4.51 |
| 4,637,478 | A | 1/1987 | George | |
| 4,693,314 | A | 9/1987 | Wesson et al. | |
| 4,768,597 | A * | 9/1988 | Lavigne et al. | 175/4.51 |
| 4,844,161 | A * | 7/1989 | Rankin et al. | 166/250.17 |
| 5,010,964 | A * | 4/1991 | Cornette | 175/4.51 |
| 5,040,619 | A * | 8/1991 | Jordan et al. | 175/4.51 |
| 5,211,714 | A | 5/1993 | Jordan et al. | |
| 5,223,665 | A | 6/1993 | Burleson et al. | |

(Continued)

FOREIGN PATENT DOCUMENTS

EP 1448868 A1 8/2004

OTHER PUBLICATIONS

ISR and Written Opinion for PCT/US2010/023545 (International Searching Authority—EPO) Sep. 27, 2010.

*Primary Examiner* — Thomas Bomar
*Assistant Examiner* — Sonya Bible
(74) *Attorney, Agent, or Firm* — Lawrence R. Youst

(57) ABSTRACT

A perforating apparatus (100) used to perforate a subterranean well. The perforating apparatus (100) includes a generally tubular gun carrier (106) and a charge holder (104) rotatably mounted within the gun carrier (106). At least one shaped charge (102) is mounted in the charge holder (104) and is operable to perforate the well upon detonation. A dynamically adjustable weight system (124) is operably associated to the charge holder (104). The dynamically adjustable weight system (124) is operable to adjust the center of gravity (120) of the charge holder (104) such that gravity will cause the charge holder (104) to rotate within the gun carrier (106) to position the at least one shaped charge (102) in a desired circumferential direction relative to the well prior to perforating.

13 Claims, 7 Drawing Sheets

U.S. PATENT DOCUMENTS 5,287,924 A 2/1994 Burleson et al.
5,355,957 A 10/1994 Burleson et al.
5,529,127 A 6/1996 Burleson et al.
5,598,894 A 2/1997 Burleson et al.
5,603,379 A * 2/1997 Henke et al. ..... 166/297
5,823,266 A 10/1998 Burleson et al.
5,957,209 A 9/1999 Burleson et al.
5,964,294 A * 10/1999 Edwards et al. ..... 166/297
5,992,289 A 11/1999 George et al.
5,992,523 A 11/1999 Burleson et al.
6,006,833 A 12/1999 Burleson et al.
6,012,525 A 1/2000 Burleson et al.
6,595,290 B2 7/2003 George et al.
6,679,327 B2 * 1/2004 Sloan et al. ..... 166/297
6,820,693 B2 11/2004 Hales et al.
7,000,699 B2 * 2/2006 Yang et al. ..... 166/255.2
7,114,564 B2 * 10/2006 Parrott et al. ..... 166/255.2
7,147,060 B2 * 12/2006 Huber et al. ..... 166/381
7,195,066 B2 3/2007 Sukup et al.
7,237,487 B2 * 7/2007 Myers et al. ..... 102/306
7,270,178 B2 * 9/2007 Selph ..... 166/105.5
7,387,156 B2 6/2008 Drummond et al.
7,409,993 B2 * 8/2008 Han et al. ..... 166/297
7,430,965 B2 10/2008 Walker
2003/0098158 A1 5/2003 George et al.
2003/0188867 A1 10/2003 Parrott et al.
2006/0118303 A1 6/2006 Schultz et al.
2007/0119327 A1 * 5/2007 Myers et al. ..... 102/306
2008/0264639 A1 10/2008 Parrott et al.
2009/0151588 A1 * 6/2009 Burleson et al. ..... 102/310

* cited by examiner 8B
8B
208
210
204
206

208
210

8D
8D
8E
8E
216
212
218
214

216
212
218
214

212
214
218

8F
8F
212
202
216
208
200
204
206
214

200
210
218
212
216

SYSTEM AND METHOD FOR DYNAMICALLY ADJUSTING THE CENTER OF GRAVITY OF A PERFORATING APPARATUS

TECHNICAL FIELD OF THE INVENTION

This invention relates, in general, to perforating a wellbore that traverses a fluid bearing subterranean formation using shaped charges and, in particular, to an apparatus and method for dynamically adjusting the center of gravity of a perforating apparatus.

BACKGROUND OF THE INVENTION

Without limiting the scope of the present invention, its background will be described with reference to perforating a subterranean formation with a shaped charge perforating apparatus, as an example.

After drilling the various sections of a subterranean wellbore that traverses a formation, individual lengths of relatively large diameter metal tubulars are typically secured together to form a casing string that is positioned within the wellbore. This casing string increases the integrity of the wellbore and provides a path for producing fluids from the producing intervals to the surface. Conventionally, the casing string is cemented within the wellbore. To produce fluids into the casing string, hydraulic opening or perforation must be made through the casing string, the cement and a short distance into the formation.

Typically, these perforations are created by detonating a series of shaped charges located within the casing string that are positioned adjacent to the desired formation. Specifically, one or more charge carriers are loaded with shaped charges that are connected with a detonating device, such as detonating cord. The charge carriers are then connected within a tool string that is lowered into the cased wellbore at the end of a tubing string, wireline, slick line, coil tubing or the like. Once the charge carriers are properly positioned in the wellbore such that the shaped charges are adjacent to the formation to be perforated, the shaped charges are detonated. Upon detonation, the shaped charges create jets that blast through scallops or recesses in the carrier. Each jet creates a hydraulic opening through the casing and the cement and enters the formation forming a perforation.

It has been found, however, that it is sometimes desirable to perforate a wellbore in a particular direction or range of directions relative to the wellbore. For example, in a deviated, inclined or horizontal well, it is frequently beneficial to form perforations in the upward direction, the downward direction or both. Attempts have been made to achieve this goal of perforating wells in particular directions. One method of orienting perforating charges downhole requires the charges to be rigidly mounted in a gun carrier so that they are pointed in the desired directions relative to the carrier. The gun carrier is then conveyed into a wellbore and either laterally biased physically to one side of the wellbore so that the gun carrier seeks the lower portion of the wellbore due to gravity, or the gun carrier is rotatably supported with its center of gravity laterally offset relative to the wellbore. This method relies on the gun carrier rotating in the wellbore, so that the gun carrier may be oriented relative to the force of gravity. Frequently, such orienting rotation is unreliable due to friction between the gun carrier and the wellbore, debris in the wellbore or the like.

More recently, the assignee of the present invention has developed a perforating gun that includes a tubular gun carrier, multiple perforating charges, multiple charge mounting structures and multiple rotating supports. This internally oriented perforating apparatus has successfully provided increased reliability in orienting perforating charges to shoot in the desired directions in a well. In this design, the direction or directions of the perforations is established when the gun is assembly in its manufacturing facility.

It has been found, however, that in certain installations, it is necessary to avoid shooting in a particular direction or directions. For example, one or more communication conduits or controls lines may extend along the exterior of the casing string. During installation, these conduits commonly become wound around the casing string such that the exact location of these lines can only determined after installation by, for example, logging the well.

A need has therefore arisen for an apparatus and method operable to achieve reliable downhole orientation of the shaped charges in a perforating apparatus such that the shaped charges shoot in desired directions. In addition, a need has arisen for such an apparatus and method operable to achieve reliable downhole orientation of the shaped charges in a perforating apparatus such that the shaped charges do not shoot in undesired directions.

SUMMARY OF THE INVENTION

The present invention disclosed herein comprises an apparatus and method for dynamically adjusting the center of gravity of a perforating apparatus. The apparatus and method of the present invention are operable to achieve reliable downhole orientation of shaped charges in a perforating apparatus such that the shaped charges shoot in desired directions. In addition, apparatus and method of the present invention are operable to achieve reliable downhole orientation of shaped charges in a perforating apparatus such that the shaped charges do not shoot in undesired directions In one aspect, the present invention is directed to a perforating apparatus used to perforate a subterranean well. The perforating apparatus includes a generally tubular gun carrier having a charge holder rotatably mounted therein. At least one shaped charge is mounted in the charge holder and is operable to perforate the well upon detonation. A dynamically adjustable weight system is operably associated to the charge holder. The dynamically adjustable weight system is operable to adjust the center of gravity of the charge holder such that gravity will cause the charge holder to rotate within the gun carrier to position the at least one shaped charge in a desire circumferential direction relative to the well prior to perforating.

In one embodiment, the dynamically adjustable weight system includes a plurality of discrete weights that are individually coupled to the charge holder at a plurality of longitudinal locations. In this embodiment, for each of the longitudinal locations, the charge holder may include a plurality of circumferentially distributed openings such as uniformly distributed openings at between about 15 and 60 degree increments. Alternatively, for each of the longitudinal locations, the charge holder may include a circumferentially extending slot that may extend circumferentially between about 90 and 180 degrees.

In another embodiment, the dynamically adjustable weight system includes a plurality of longitudinally extending tubes operable to contain a weighted material therein. In a further embodiment, the dynamically adjustable weight system includes weights formed from a malleable material. In yet another embodiment, the dynamically adjustable weight system includes a weight tube that is rotatable relative to the charge holder. In any of these embodiments, the at least one shaped charge may include a plurality of shaped charges that may be positioned in the charge holder to fire in substantially the same circumferential direction or the shaped charges may be positioned in the charge holder to fire in multiple circumferential directions.

In another aspect, the present invention is directed to a perforating apparatus used to perforate a subterranean well. The perforating apparatus includes a generally tubular gun carrier having a charge tube rotatably mounted therein. The charge tube includes a plurality of circumferentially extending slots. At least one shaped charge is mounted in the charge tube and is operable to perforate the well upon detonation. A dynamically adjustable weight system is coupled to the charge tube. The dynamically adjustable weight system includes a plurality of discrete weights that are coupled to the charge tube at the slots such that the circumferential location of the weights is adjustable along the length of the slots to adjust the center of gravity of the charge tube such that gravity will cause the charge tube to rotate within the gun carrier to position the at least one shaped charge in a desired circumferential direction relative to the well prior to perforating.

In one embodiment, adjacent slots in the charge tube extend in circumferentially opposite directions. In another embodiment, the weights are attached to the charge tube using bolts that are selectively slidable within the slots.

In another aspect, the present invention is directed to a method of perforating a subterranean well. The method includes identifying at least one undesired circumferential direction associated with a perforating interval in the well; adjusting components of a dynamically adjustable weight system to change the center of gravity of a charge holder rotatably mounted within a gun carrier; positioning the gun carrier within the perforating interval in the well; gravitationally aligning a least one shaped charge mounted in the charge holder in at least one desired circumferential direction relative to the well that does not correspond with the at least one undesired circumferential direction; and firing the at least one shaped charge to perforate the well in the at least one desired circumferential direction.

The method may also include relocating discrete weights circumferentially about the charge holder. This may be accomplished by relocating the discrete weights relative to circumferentially distributed openings in the charge holder or relocating the discrete weights relative to circumferentially extending slots in the charge holder. Alternatively, the method may include changing the amount of weighted material in at least one longitudinally extending tube, reshaping malleable material disposed within the charge holder or rotating a weight tube relative to the charge holder.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
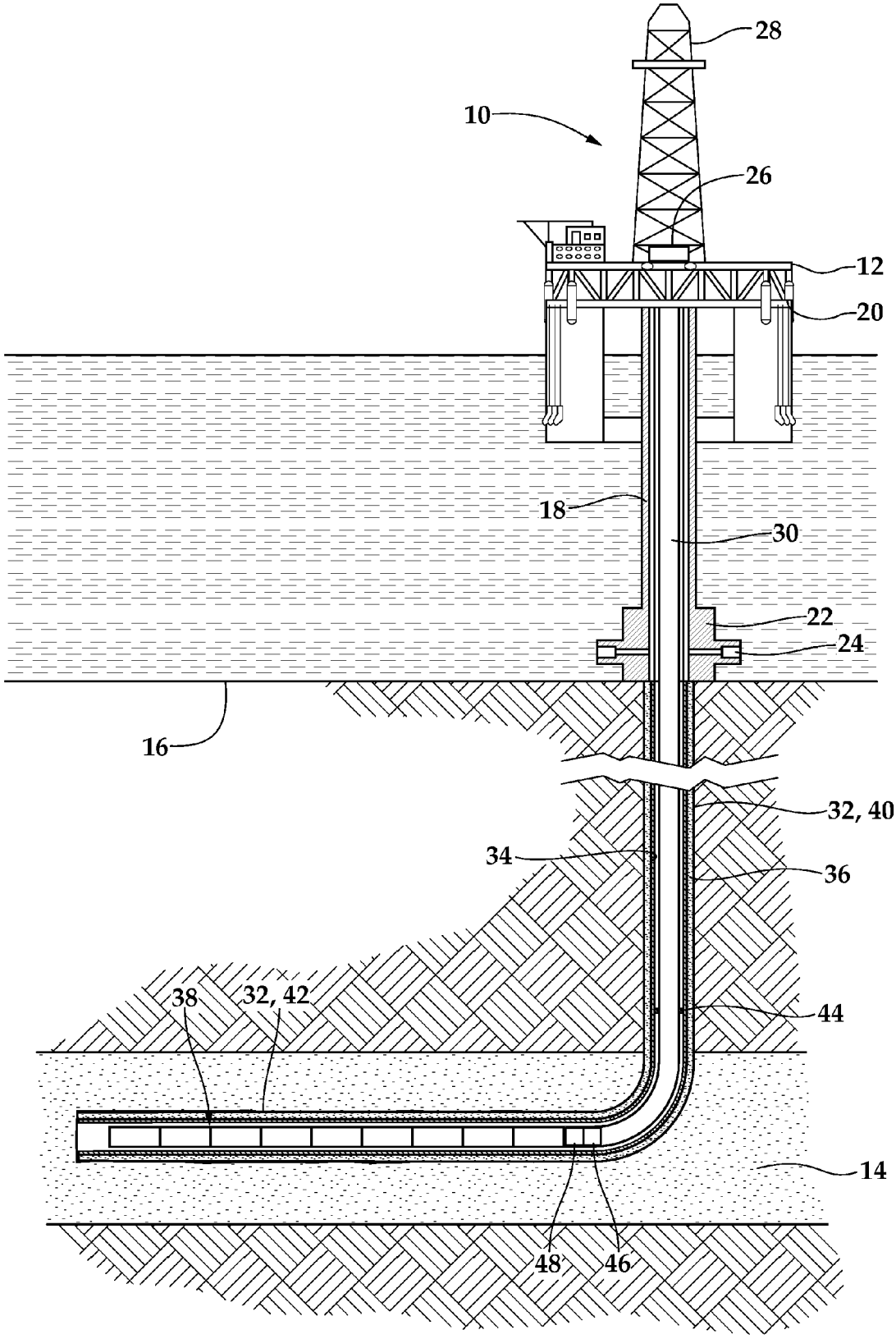
FIG. 1 is a schematic illustration of an offshore oil and gas platform operating a plurality of apparatuses for dynamically adjusting the center of gravity of perforating apparatuses of the present invention.

Referring initially to FIG. 1, a plurality of apparatuses for dynamically adjusting the center of gravity of perforating apparatuses operating from an offshore oil and gas platform are schematically illustrated and generally designated 10. A semi-submersible platform 12 is centered over a submerged oil and gas formation 14 located below sea floor 16. A subsea conduit 18 extends from deck 20 of platform 12 to wellhead installation 22 including subsea blow-out preventers 24. Platform 12 has a hoisting apparatus 26 and a derrick 28 for raising and lowering pipe strings such as work sting 30.

A wellbore 32 extends through the various earth strata including formation 14. A casing 34 is cemented within wellbore 32 by cement 36. Work string 30 includes various tools such as a plurality of perforating apparatuses or guns 38. When it is desired to perforate casing 34, work string 30 is lowered through casing 34 until the perforating guns 38 are properly positioned relative to formation 14. Thereafter, the shaped charges within the string of perforating guns 38 are sequentially fired, either in an uphole to downhole or a downhole to uphole direction. Upon detonation, the liners of the shaped charges form jets that create a spaced series of perforations extending outwardly through casing 34, cement 36 and into formation 14, thereby allow fluid communication between formation 14 and wellbore 32.

In the illustrated embodiment, wellbore 32 has an initial, generally vertical portion 40 and a lower, generally deviated portion 42 which is illustrated as being horizontal. It should be noted, however, by those skilled in the art that the apparatus for dynamically adjusting the center of gravity of a perforating apparatus of the present invention is equally well-suited for use in other well configurations including, but not limited to, inclined wells, wells with restrictions, non-deviated wells, multilateral wells and the like. In addition, even though an offshore operation has been depicted in FIG. 1, the apparatus for dynamically adjusting the center of gravity of a perforating apparatus of the present invention is equally well-suited for use in onshore operations.

Work string 30 includes a packer 44 that may be sealingly engaged with casing 34 and is illustrated in the vertical portion 40 of wellbore 32. At the lower end of work string 30 is the gun string including the plurality of perforating guns 38, a ported nipple 46 and a fire head 48. In the illustrated embodiment, perforating guns 38 include internal orientation features which allow for reliable rotation of the charge tube within the gun carrier as described in U.S. Pat. No. 6,595,290 issued to Halliburton Energy Services, Inc. on Jul. 22, 2003, which is hereby incorporated by reference for all purposes.

Figure 2:
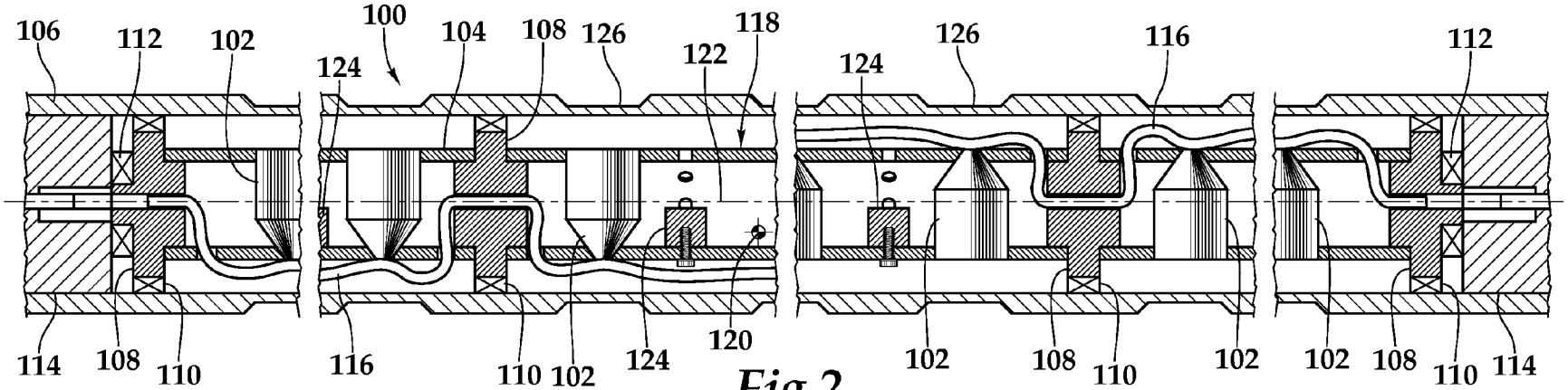
FIG. 2 is a cross sectional view of one embodiment of an apparatus for dynamically adjusting the center of gravity of a perforating apparatus of the present invention.

Referring now to FIG. 2, therein is depicted a perforating apparatus that includes an apparatus for dynamically adjusting the center of gravity of the perforating apparatus of the present invention that is generally designated 100. In the following description of apparatus 100 as well as the other apparatuses and methods described herein, directional terms such as "above", "below", "upper", "lower" and the like are used for convenience in referring to the illustrations as it is to be understood that the various embodiments of the invention may be used in various orientations such as inclined, inverted, horizontal, vertical and the like and in various configurations, without departing from the principles of the invention.

Gun 100 includes a plurality of shaped charges 102 that are securably mounted in a charge holder that is depicted as charge tube 104. Charge tube 104 is rotatably mounted within gun carrier 106. Preferably, charge tube 104 is made from cylindrical tubing, but it should be understood that it is not necessary for charge tube 104 to be tubular or have a cylindrical shape in keeping with the principles of the invention. Charge tube 104 includes multiple supports 108 that allow charge tube 104 to rotate within gun carrier 106. This manner of rotatably supporting charge tube 104 prevents charges 102 or any other portion of charge tube 104 from contacting the interior of gun carrier 106.

Each of the supports 108 includes rolling elements or bearings 110 contacting the interior of gun carrier 106. For example, bearings 110 could be ball bearings, roller bearings, plain bearings or the like. Bearings 110 enable supports 108 to suspend charge tube 104 in gun carrier 106 and permit rotation thereof. In addition, optional thrust bearings 112 may be positioned between each end of charge tube 104 and gun carrier 106 such that thrust bearings 112 contact devices 114 attached at each end of gun carrier 106. Each device 114 may be tandems that are used to couple two guns to each other, a bull plug used to terminate a gun string, a firing head, or any other type of device which may be attached to gun carrier 106. As with bearings 110 described above, thrust bearings 112 may be any type of bearings. Thrust bearings 112 support charge tube 104 against axial loading within gun carrier 106, while permitting charge tube 104 to rotate within gun carrier 106.

Charge tube 104, charges 102 and other portions of gun 100 supported in gun carrier 106 by the supports 108 including, for example, a detonating cord 116 extending to each of the charges and portions of the supports themselves, are parts of an overall rotating assembly 118. By offsetting a center of gravity 120 of assembly 118 relative to a longitudinal rotational axis 122 of bearings 110, assembly 118 is biased by gravity to rotate to a specific position in which the center of gravity 120 is located directly below the rotational axis 122.

Assembly 118 may, due the construction of the various elements thereof, initially have the center of gravity 120 in a desired position relative to charges 102. However, to ensure that charges 102 are directed to shoot in respective predetermined directions, the center of gravity 120 may be repositioned using a dynamically adjustable weight system that is depicted as weights 124. In the illustrated embodiment, on the left side of FIG. 2, weights 124 are added to assembly 118 to direct the charges 102 to shoot upward, while on the right side of FIG. 2, weights 124 are added to assembly 118 to direct the charges 102 to shoot downward. As discussed in greater detail below, weights 124 may be otherwise positioned to direct the charges 102 to shoot in any desired direction, or combination of directions and to avoid shooting in undesired directions.

Gun carrier 106 is provided with reduced wall thickness portions 126, which extend circumferentially about carrier 106 outwardly overlying each of the charges 102. Thus, as the charges 102 rotate within carrier 106, they remain directed to shoot through the portions 126. The reduced wall thickness portions 126 may be formed on carrier 106 by rolling, forging, lathe cutting or any other suitable technique.

Figure 3A:
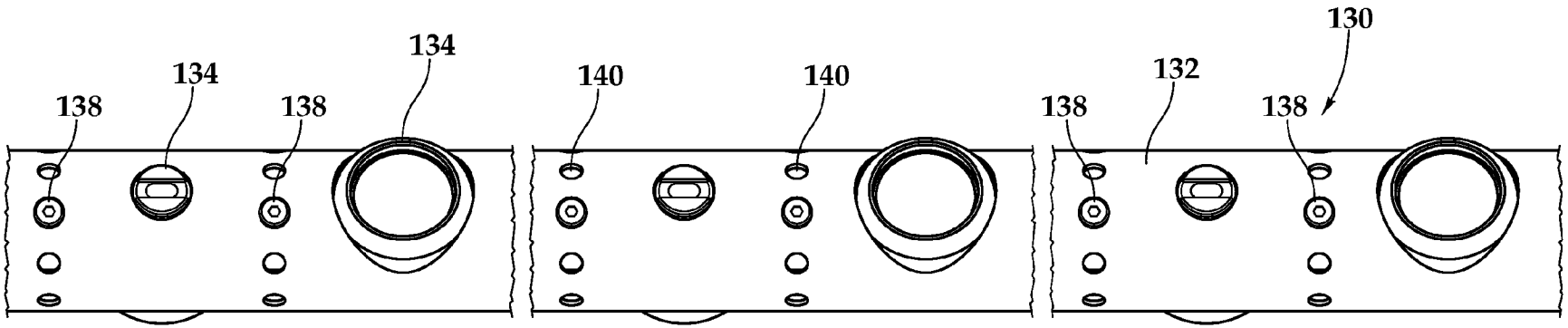
FIGS. 3A-3B are side and cross sectional views of one embodiment of an apparatus for dynamically adjusting the center of gravity of a perforating apparatus of the present invention.
Figure 3B:
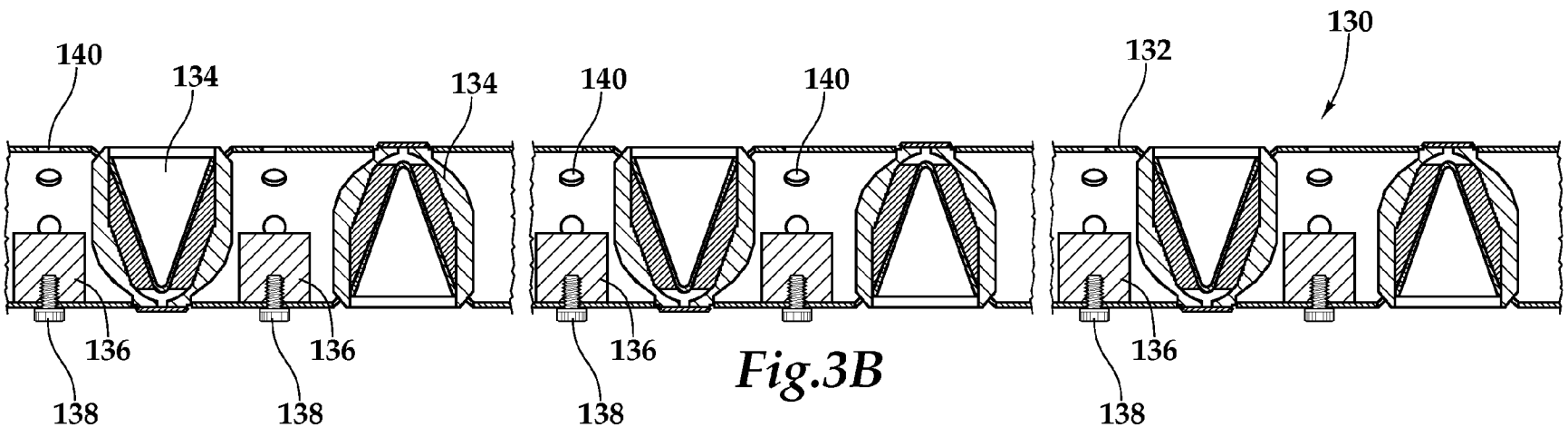

Referring next to FIGS. 3A and 3B, therein are depicted side and cross sectional views of an apparatus for dynamically adjusting the center of gravity of a perforating apparatus of the present invention that is generally designated 130. Apparatus 130 includes a charge holder depicted as charge tube 132 which houses a plurality of shaped charges 134. In the illustrated embodiment, shaped charges 134 are configured in a 180 degree phased pattern, however, those skilled in the art will appreciate that any number of alternative phased patterns of the shaped charges are possible and are considered within the scope of the present invention.

Apparatus 130 also includes a dynamically adjustable weight system depicted as weights 136. In the illustrated embodiment, each of the weights 136 includes a threaded portion that is operable to receive therein a complementary threaded bolt 138. Weights 136 are accordingly attached to charge tube 132 by passing the shaft portion of a bolt 138 through one of a plurality of openings 140 in charge tube 132 and then rotatably coupling that bolt 138 to one of the weights 136. As illustrated, each longitudinal location of charge tube 132 that is designed to receive a weight 136 has eight openings 140 that are circumferentially spaced apart at 45 degree increments. It should be understood by those skilled in the art, however, that any number of openings having any desired circumferentially spacing both uniform and nonuniform is possible and is considered within the scope of the present invention, so long as the structural integrity of charge tube 132 is maintained. For example, it may be desirable to have openings that are circumferentially spaced uniformly around a charge tube at between about 15 and about 60 degree increments.

As used herein, the term dynamically adjustable refers to the ability to change the center of gravity of a perforating apparatus in the field as opposed to only as the perforating apparatus is manufactured. This ability provides the versatility to make adjustments to apparatus 130 that will not only allow the field personnel to shoot in a desired direction but also prevent shooting in an undesired direction, such as in the direction of a control line disposed to the exterior of the casing string. Continuing with this example, if one or more control lines are position to the exterior of the casing string, it is imperative to avoid causing damage to the control lines during the perforating process. As these control lines commonly take on a spiral configuration around the casing string during installation, the actual location of the control lines must be determined prior to perforating the well by, for example, logging the well. Once the circumferential location of the control lines is known for each depth of the well, the present invention allows field personnel to custom design the perforating gun string such that the control lines can be avoided and the well can be perforated in the desired directional orientations.

In the illustrated embodiment, this is accomplished by repositioning the weights 136 relative to any one of the respective openings 140 circumferentially spaced around charge tube 132. For example, if charge tube 132 were installed within a gun carrier as configured in FIG. 3B and deployed in a horizontal well, weights 136 would cause charge tube 132 to rotate to the position depicted in FIG. 3B wherein shaped charges 134 would fire at 0 and 180 degrees in the well. If weights 136 were each moved to the next adjacent position, shaped charges 134 would fire at 45 and 225 degrees in the well. Likewise, if weights 136 were each moved again to the next adjacent position, shaped charges 134 would fire at 90 and 270 degrees in the well. Accordingly, the directions the shaped charges will perforate the well may be dynamically adjusted by field personnel after the location of any wellbore hazards has been determined.

Even though FIGS. 3A-3B have depicted apparatus 130 as having one weight positioned between adjacent shaped charge, it should be understood by those skilled in the art that no particular relationship is required between the number of weights and the number of shaped charges in a given perforating apparatus. The number and configuration of the weights and shaped charges will vary based upon factors such as the desired shots per foot, the diameter of the charge tube, the explosive mass of the charges, the size of the weights, the spacing between charges and the like. The important factor is that the center of gravity is dynamically adjustable to cause the charge tube to rotate within the gun carrier to the desired position.

Figure 4A:
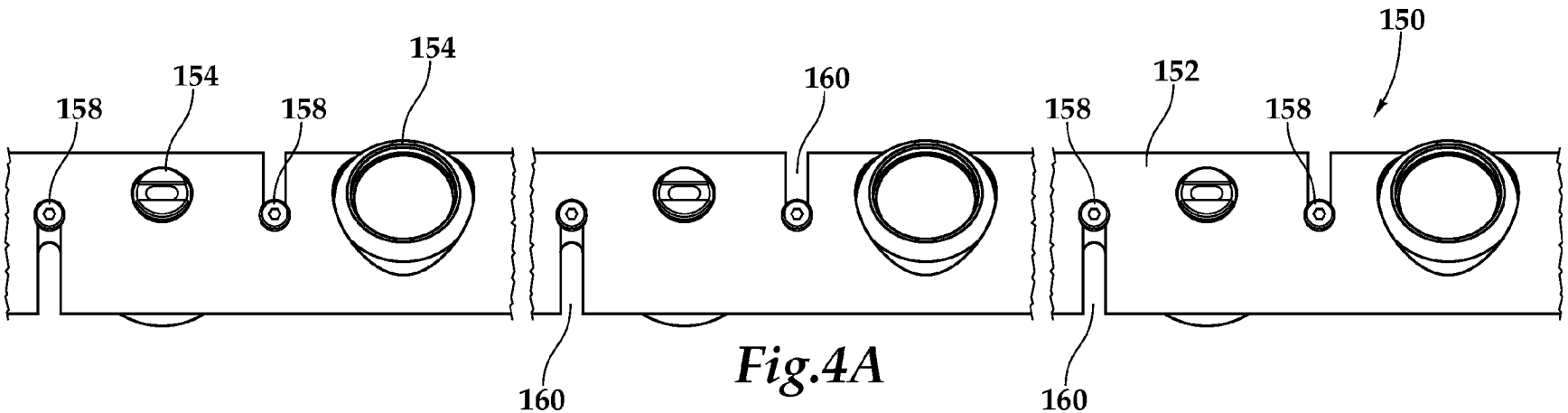
FIGS. 4A-4B are side and cross sectional views of one embodiment of an apparatus for dynamically adjusting the center of gravity of a perforating apparatus of the present invention.
Figure 4B:
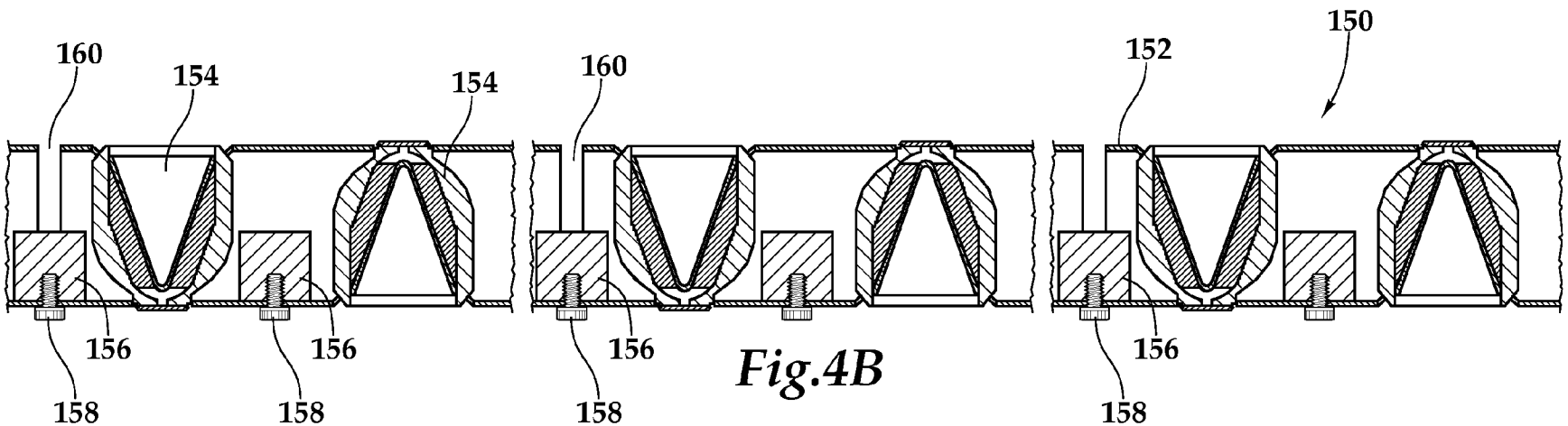

Referring next to FIGS. 4A and 4B, therein are depicted side and cross sectional views of an apparatus for dynamically adjusting the center of gravity of a perforating apparatus of the present invention that is generally designated 150. Apparatus 150 includes a charge holder depicted as charge tube 152 which houses a plurality of shaped charges 154. In the illustrated embodiment, shaped charges 154 are configured in a 180 degree phased pattern, however, those skilled in the art will appreciate that any number of alternative phased patterns of the shaped charges are possible and are considered within the scope of the present invention.

Apparatus 150 also includes a dynamically adjustable weight system depicted as weights 156. In the illustrated embodiment, each of the weights 156 includes a threaded portion that is operable to receive therein a complementary threaded bolt 158. Weights 156 are accordingly attached to charge tube 152 by passing the shaft portion of a bolt 158 through a slot 160 in charge tube 152 and then rotatably coupling that bolt 158 to one of the weights 156. As illustrated, each longitudinal location of charge tube 152 that is designed to receive a weight 156 has a slot 160 that circumferentially traverses 180 degrees of charge tube 152. Adjacent slots 160 of apparatus 150 are configured such that they extend on opposite sides of charge tube 152. This design enhances the structural integrity of charge tube 152 and allows for infinite variability in the center of gravity of apparatus 150. In certain implementations weights 156 may be placed in each of the slots 160. In other implementations, it may be desirable to have weights 156 in every other slot 160 such that each of the weights 156 can be positioned at the same circumferential position. It should be understood by those skilled in the art that slots 160 could have other circumferential orientations and could have other relative spacing arrangement, both uniform and nonuniform, without departing from the principles of the present invention, so long as the structural integrity of charge tube 152 is maintained.

As discussed above, the combination of slots 160 and weights 156 allow for dynamic adjustments in the center of gravity of a perforating apparatus in the field. This ability provides the versatility to make adjustments to apparatus 150 that will not only allow the field personnel to shoot in a desired direction but also prevent shooting in an undesired direction, such as in the direction of a control line or other hazard disposed to the exterior of the casing string or within the casing string. Specifically, in the illustrated embodiment, this is accomplished by circumferentially repositioning the weights 156 along slots 160 by loosening bolts 158, sliding the weights 156 to the desired circumferential position and resecuring the weights 156 to charge tube 152 with the bolts 158. If charge tube 152 were installed within a gun carrier as loaded in FIG. 4B and deployed in a horizontal well, weights 156 would cause charge tube 152 to rotate to the position depicted in FIG. 4B wherein shaped charges 154 would fire at 0 and 180 degrees in the well. Repositioning of the weights 156 along slots 160, as described above, would allow for firing in any desired circumferential directions. Accordingly, the directions the shaped charges will perforate the well may be dynamically adjusted by field personnel after the location of any wellbore hazards has been determined.

Figure 5:
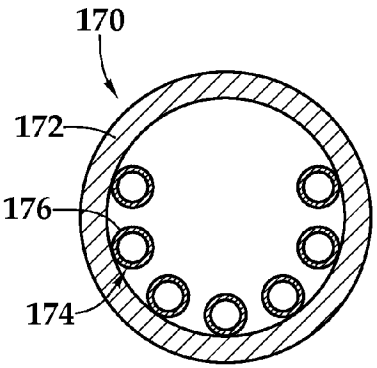
FIG. 5 is a cross sectional view of one embodiment of an apparatus for dynamically adjusting the center of gravity of a perforating apparatus of the present invention.

Referring next to FIG. 5, therein is depicted a cross sectional view of an apparatus for dynamically adjusting the center of gravity of a perforating apparatus of the present invention that is generally designated 170. Apparatus 170 includes a charge holder depicted as charge tube 172 which houses a plurality of shaped charges (not pictured). Apparatus 170 also includes a dynamically adjustable weight system 174 that is depicted a plurality of tubes 176. Tubes 176 extend at least partially longitudinally within charge tube 172 and are operable to contain a weighted material such as a fluid or a solid. As illustrated, apparatus 170 includes seven tubular tubes 176 that are circumferentially distributed within charge tube 172 at 30 degree increments. It should be understood by those skilled in the art that tubes 176 could have other circumferential orientations, both uniform and nonuniform, within charge tube 172 without departing from the principles of the present invention. Likewise, even though tubes 176 are depicted as having a tubular cross section, tubes 176 could alternatively have other cross sections including, but not limited to, oval cross sections, rectangular cross sections, arc shaped cross sections and the like. In addition, those skilled in the art will recognize that not all of tubes 176 need to have the same cross section or be of the same size.

In operation, dynamically adjustable weight system 174 of apparatus 170 allows field personnel to make dynamic adjustments in the center of gravity of a perforating apparatus in the field. This ability provides the versatility to make adjustments to apparatus 170 that will not only allow the field personnel to shoot in a desired direction but also prevent shooting in an undesired direction, such as in the direction of a control line or other hazard disposed to the exterior of the casing string or within the casing string. Specifically, in the illustrated embodiment, this is accomplished by adding or reducing the weight within tubes 176 by, for example, adding or removing a fluid such as water from tubes 176. As the weight is adjusted in the various tubes 176, the desired downhole rotation of charge tube 172 can be achieved. Accordingly, the directions the shaped charges will perforate the well may be dynamically adjusted by field personnel after the location of any wellbore hazards has been determined.

Figure 6:
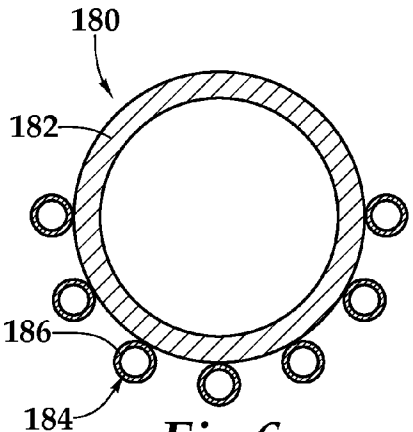
FIG. 6 is a cross sectional view of one embodiment of an apparatus for dynamically adjusting the center of gravity of a perforating apparatus of the present invention.

Referring next to FIG. 6, therein is depicted a cross sectional view of an apparatus for dynamically adjusting the center of gravity of a perforating apparatus of the present invention that is generally designated 180. Apparatus 180 includes a charge holder depicted as charge tube 182 which houses a plurality of shaped charges (not pictured). Apparatus 180 also includes a dynamically adjustable weight system 184 that is depicted a plurality of tubes 186. Tubes 186 extend at least partially longitudinally along the exterior of charge tube 182 and are operable to contain a weighted material such as a fluid or a solid. As illustrated, apparatus 180 includes seven tubular tubes 186 that are circumferentially distributed within charge tube 182 at 30 degree increments. It should be understood by those skilled in the art that tubes 186 could have other circumferential orientations, both uniform and nonuniform, within charge tube 182 without departing from the principles of the present invention. Likewise, even though tubes 186 are depicted as having a tubular cross section, tubes 186 could alternatively have other cross sections including, but not limited to, oval cross sections, rectangular cross sections, arc shaped cross sections and the like. In addition, those skilled in the art will recognize that not all of tubes 186 need to have the same cross section or be of the same size.

In operation, dynamically adjustable weight system 184 of apparatus 180 allows field personnel to make dynamic adjustments in the center of gravity of a perforating apparatus in the field. This ability provides the versatility to make adjustments to apparatus 180 that will not only allow the field personnel to shoot in a desired direction but also prevent shooting in an undesired direction, such as in the direction of a control line or other hazard disposed to the exterior of the casing string or within the casing string. Specifically, in the illustrated embodiment, this is accomplished by adding or reducing the weight within tubes 186 by, for example, adding or removing a fluid such as water from tubes 186. As the weight is adjusted in the various tubes 186, the desired downhole rotation of charge tube 182 can be achieved. Accordingly, the directions the shaped charges will perforate the well may be dynamically adjusted by field personnel after the location of any wellbore hazards has been determined.

Even though FIGS. 5 and 6 have depicted tubes located respectively inside and outside of a charge tube that are operable to receive a weighted material therein, those skilled in the art should recognize that alternate configurations could also be used and would be considered within the scope of the present invention including, but not limited to, forming one or more passageways in the wall of the charge tube or similar tubular operable to receive a weighted material therein.

Figure 7B:
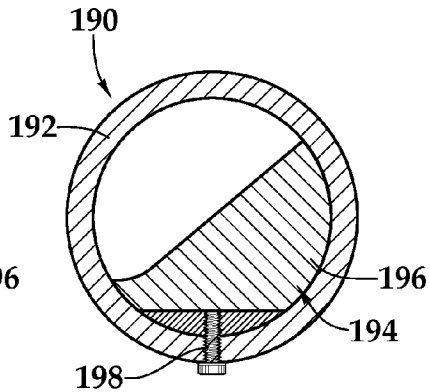
FIGS. 7A-7B are a cross sectional views of one embodiment of an apparatus for dynamically adjusting the center of gravity of a perforating apparatus of the present invention.
Figure 7A:
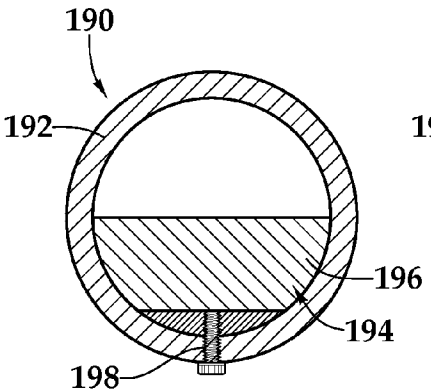

Referring next to FIGS. 7A and 7B, therein is depicted cross sectional views of an apparatus for dynamically adjusting the center of gravity of a perforating apparatus of the present invention that is generally designated 190. Apparatus 190 includes a charge holder depicted as charge tube 192 which houses a plurality of shaped charges (not pictured). Apparatus 190 also includes a dynamically adjustable weight system 194 that is depicted as malleable weight members 196 that may be formed from a metal such as lead or a polymer. Malleable weight members 196 may extend at least partially longitudinally along the interior of charge tube 192 or may be discrete weight elements similar to weights 136 and 156 described above. As illustrated, each malleable weight member 196 is coupled to charge tube 192 using one or more bolts 198. In operation, dynamically adjustable weight system 194 of apparatus 190 allows field personnel to make dynamic adjustments in the center of gravity of a perforating apparatus in the field. This ability provides the versatility to make adjustments to apparatus 190 that will not only allow the field personnel to shoot in a desired direction but also prevent shooting in an undesired direction, such as in the direction of a control line or other hazard disposed to the exterior of the casing string or within the casing string. Specifically, in the illustrated embodiment, this is accomplished by applying pressure or force to the malleable material that forms malleable weight members 196 using, for example, an adjustment tool that is sized to extend into charge tube 192. The location of at least a portion of the mass of malleable weight members 196 can them be adjusted, as seen in a comparison of FIGS. 7A and 7B, such that the desired downhole rotation of charge tube 192 can be achieved. Accordingly, the directions the shaped charges will perforate the well may be dynamically adjusted by field personnel after the location of any wellbore hazards has been determined.

Figures 8A, 8B, 8C, 8D, 8E, 8F, 8G:
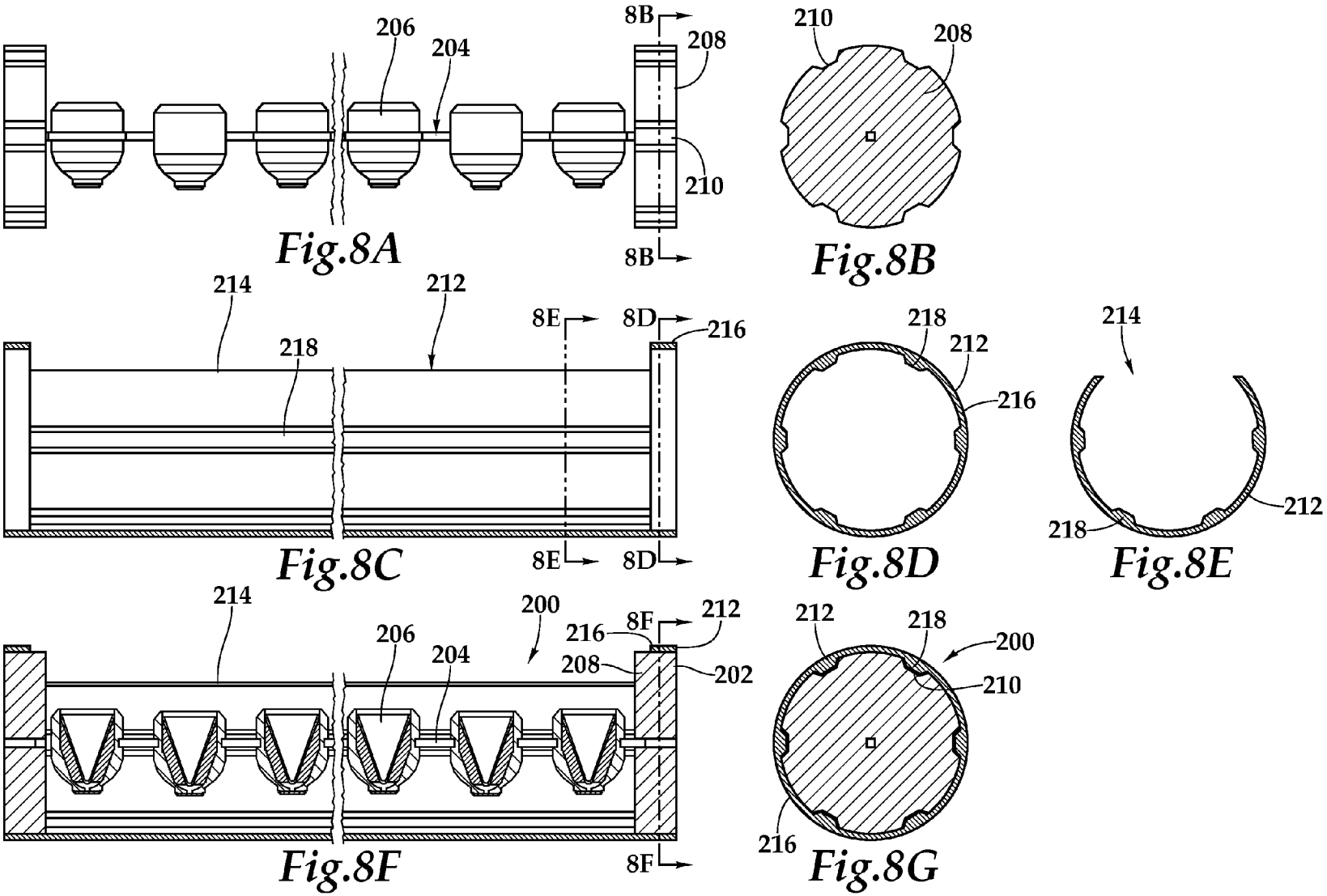
FIGS. 8A-8G are various views of one embodiment of an apparatus for dynamically adjusting the center of gravity of a perforating apparatus of the present invention.

Referring next to FIGS. 8A-8G, therein are depicted various views of an apparatus for dynamically adjusting the center of gravity of a perforating apparatus of the present invention that is generally designated 200. When assembled, apparatus 200 forms a rotating assembly 202 that is rotatably mounted in a gun carrier in a manner described above. Apparatus 200 includes a charge holder 204 that supports a plurality of shaped charges 206. Charge holder 204 is coupled to end plates 208. Each end plate 208 includes a plurality of notches 210 that are illustrated as being positioned circumferentially around end plates 208 at 60 degree increments, however, those skilled in the art will recognize that notches 210 could have alternate configurations including having different circumferential spacing. In addition, depending upon the length of charge holder 204, it may be desirable to have addition structures that are similar to end plates 208 positioned at intermediate locations along charge holder 204 between certain shaped charges 206. Apparatus 200 also includes a dynamically adjustable weight system depicted as weight tube 212. Weight tube 212 is formed from a substantially tubular member having a window 214, as best seen in FIG. 8E. In the illustrated embodiment, window 214 extends about 120 degrees circumferentially around weight tube 212, however, those skilled in the art will recognize that window 214 could have alternate configurations including having a different circumferential width or multiple window sections circumferential distributed around weight tube 212. Weight tube 212 includes circumferential end sections 216 that are sized to closely receive end plates 208. Weight tube 212 includes a plurality of rails 218 that are designed to mesh with notches 210 of end plates 208.

In operation, the dynamically adjustable weight system of apparatus 200 allows field personnel to make dynamic adjustments in the center of gravity of a perforating apparatus in the field. This ability provides the versatility to make adjustments to apparatus 200 that will not only allow the field personnel to shoot in a desired direction but also prevent shooting in an undesired direction, such as in the direction of a control line or other hazard disposed to the exterior of the casing string or within the casing string. Specifically, in the illustrated embodiment, this is accomplished by inserting charge holder 204 into weight tube 212 such that shaped charges 206 are oriented in the desired direction. For example, if charge holder 204 were installed within weight tube 212 as shown in FIG. 8F and deployed in a horizontal well, weight tube 212 would cause rotating assembly 202 to rotate to the position depicted in FIG. 8F wherein shaped charges 206 would fire at 0 degrees in the well. If charge holder 204 was rotated 60 degrees in either direction to realign rails 218 and notches 210, shaped charges 206 would fire at either 60 degrees or 300 degrees in the well. Accordingly, the directions the shaped charges will perforate the well may be dynamically adjusted by field personnel after the location of any wellbore hazards has been determined.

Figure 9A:
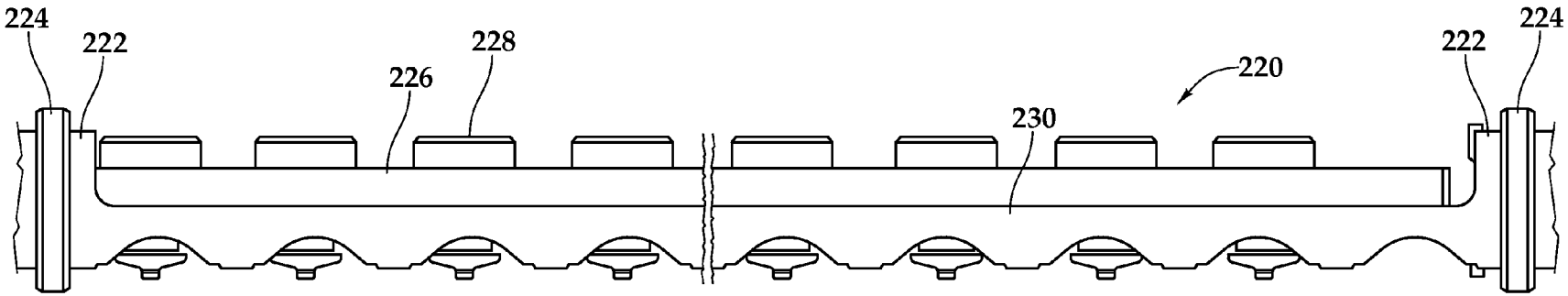
FIGS. 9A-9B are a side and top views of one embodiment of an apparatus for dynamically adjusting the center of gravity of a perforating apparatus of the present invention.
Figure 9B:
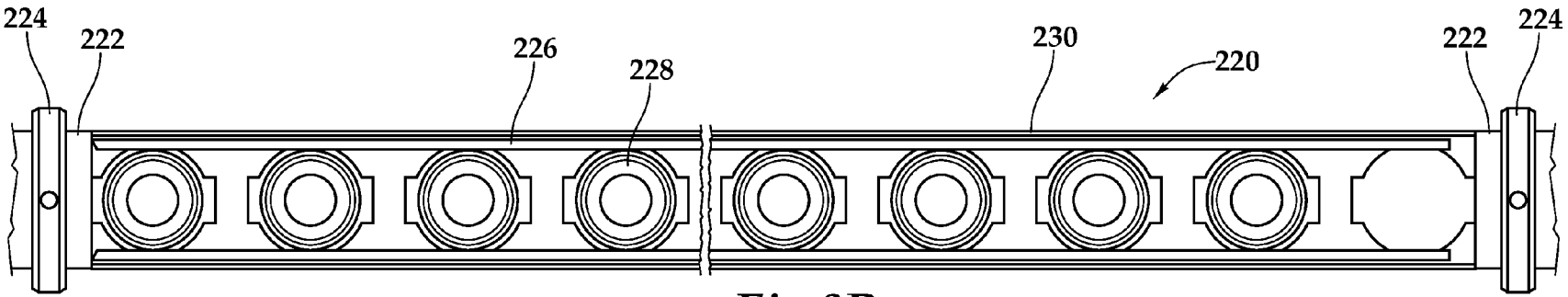

Referring next to FIGS. 9A-9B, therein are depicted side and top views of an apparatus for dynamically adjusting the center of gravity of a perforating apparatus of the present invention that is generally designated 220. When assembled, apparatus 220 forms a rotating assembly 222 that is rotatably mounted in a gun carrier in a manner described above via bearings 224. Apparatus 220 includes a charge holder 226 that supports a plurality of shaped charges 228. Apparatus 220 also includes a dynamically adjustable weight system depicted as weight tube 230. Weight tube 230 is formed from a partially tubular member. Charge holder 226 is selectively rotatable mounted within weight tube 230 such that charge holder 226 may be rotated about 120 degrees circumferentially within weight tube 230. In operation, the dynamically adjustable weight system of apparatus 220 allows field personnel to make dynamic adjustments in the center of gravity of a perforating apparatus in the field. This ability provides the versatility to make adjustments to apparatus 220 that will not only allow the field personnel to shoot in a desired direction but also prevent shooting in an undesired direction, such as in the direction of a control line or other hazard disposed to the exterior of the casing string or within the casing string. Specifically, in the illustrated embodiment, this is accomplished by selectively releasing a connection such as a pin, a set screw or the like between charge holder 226 and weight tube 230 then rotating charge holder 226 such that shaped charges 228 are oriented in the desired direction. For example, if charge holder 226 was installed within weight tube 230 as shown in FIG. 9A and deployed in a horizontal well, weight tube 230 would cause rotating assembly 222 to rotate to the position depicted in FIG. 9A wherein shaped charges 228 would fire at 0 degrees in the well. If another circumferential direction is desired, however, charge holder 226 may be incrementally adjusted in certain embodiments or infinitely adjusted in other embodiments to any position between the locations of maximum travel which have been described above as approximately 60 degrees from vertical in either direction in the illustrated embodiment. Accordingly, the directions the shaped charges will perforate the well may be dynamically adjusted by field personnel after the location of any wellbore hazards has been determined.

Figure 10A:
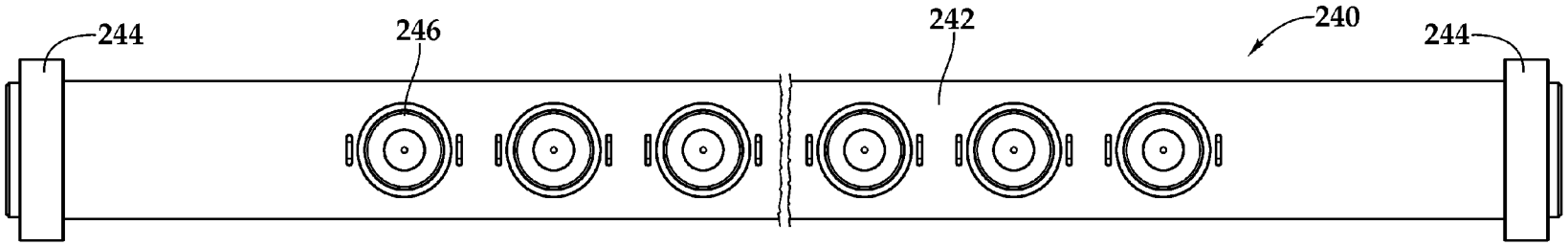
FIGS. 10A-10C are various views of one embodiment of an apparatus for dynamically adjusting the center of gravity of a perforating apparatus of the present invention.
Figure 10B:
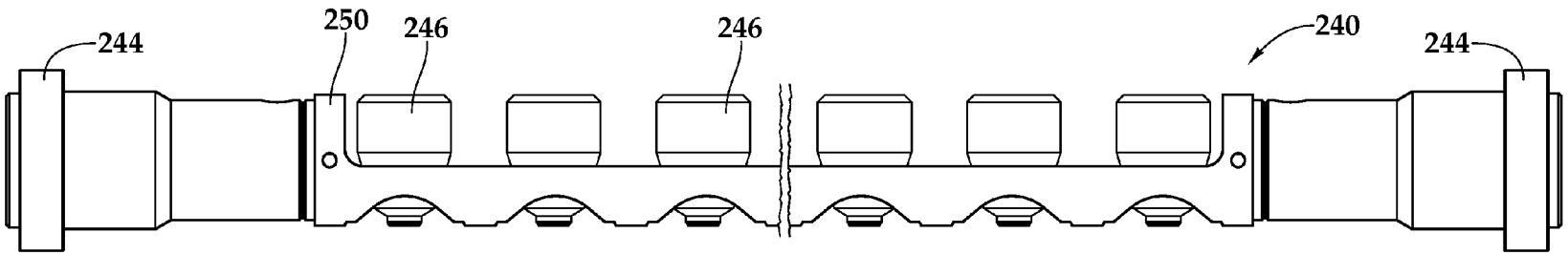
Figure 10C:
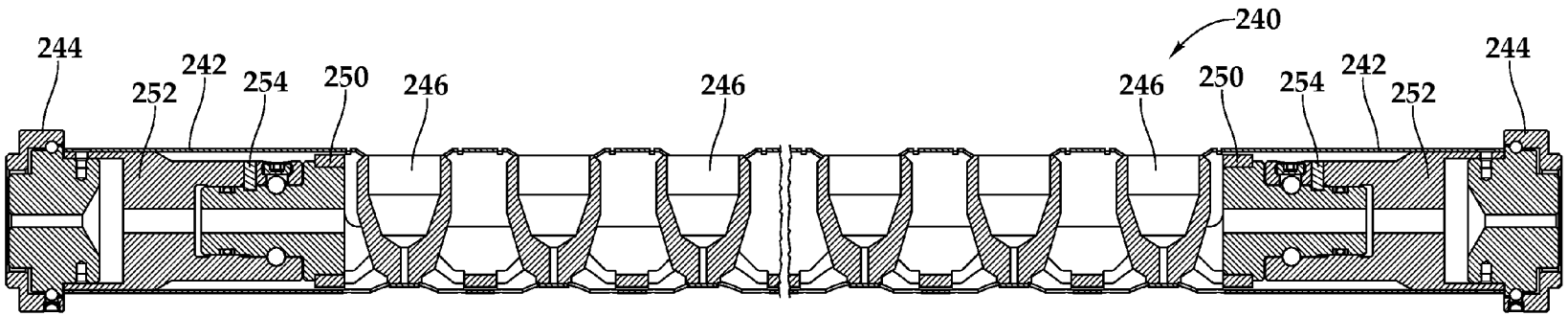

Referring next to FIGS. 10A-10C, therein are depicted various views of an apparatus for dynamically adjusting the center of gravity of a perforating apparatus of the present invention that is generally designated 240. Apparatus 240 includes a charge holder depicted as a charge tube 242 that is rotatably mounted in a gun carrier in a manner described above via bearings 244, as best seen in FIGS. 10A and 10C. Charge tube 242 supports a plurality of shaped charges 246. Apparatus 240 also includes a dynamically adjustable weight system depicted as weight tube 250, as best seen in FIGS. 10B and 10C. Weight tube 250 is formed from a partially tubular member. Weight tube 250 is rotatable mounted within a swivel member 252 that is mounted within charge tube 242 such that weight tube 250 may be rotated about 120 degrees circumferentially within charge tube 242. One or more coupling members depicted as pins 254 are used to selectively prevent rotation of weight tube 250 relative to swivel member 252. In operation, the dynamically adjustable weight system of apparatus 240 allows field personnel to make dynamic adjustments in the center of gravity of a perforating apparatus in the field. This ability provides the versatility to make adjustments to apparatus 240 that will not only allow the field personnel to shoot in a desired direction but also prevent shooting in an undesired direction, such as in the direction of a control line or other hazard disposed to the exterior of the casing string or within the casing string. Specifically, in the illustrated embodiment, this is accomplished by selectively releasing the connection, such as pins 254, between weight tube 250 and swivel member 252 then rotating weight tube 250 relative to swivel member 252 such that weight tube 250 is positioned in the desired orientation relative to shaped charges 246. For example, if weight tube 250 was installed relative to shaped charges 246 as shown in FIGS. 10B-10C and deployed in a horizontal well, weight tube 250 would cause charge tube 242 to rotate to the position depicted in FIGS. 10B-10C wherein shaped charges 246 would fire at 0 degrees in the well. If another circumferential direction is desired, however, weight tube 250 may be incrementally adjusted in certain embodiments or infinitely adjusted in other embodiments to any position between the locations of maximum travel which have been described above as approximately 60 degrees from vertical in either direction in the illustrated embodiment. Accordingly, the directions the shaped charges will perforate the well may be dynamically adjusted by field personnel after the location of any wellbore hazards has been determined.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A perforating apparatus used to perforate a subterranean well, the perforating apparatus comprising:

a generally tubular gun carrier;

a charge holder rotatably mounted within the gun carrier, the charge holder including a plurality of circumferentially distributed openings at a plurality of longitudinal locations;

at least one shaped charge mounted in the charge holder and operable to perforate the well upon detonation; and a dynamically adjustable weight system operably associated with the charge holder, the dynamically adjustable weight system including a plurality of discrete weights that are individually coupled to the charge holder at the plurality of longitudinal locations, such that the circumferential location of the weights is adjustable in the circumferentially distributed openings to adjust the center of gravity of the charge holder such that gravity will cause the charge holder to rotate within the gun carrier to position the at least one shaped charge in a desired circumferential direction relative to the well prior to perforating.

2. The perforating apparatus as recited in claim 1 wherein the circumferentially distributed openings are uniformly distributed at between about 15 and about 60 degree increments.

3. The perforating apparatus as recited in claim 1 wherein the at least one shaped charge further comprises a plurality of shaped charges and wherein each of the shaped charges is positioned in the charge holder to fire in substantially the same circumferential direction.

4. The perforating apparatus as recited in claim 1 wherein the at least one shaped charge further comprises a plurality of shaped charges and wherein the shaped charges are positioned in the charge holder to fire in multiple circumferential directions.

5. A perforating apparatus used to perforate a subterranean well, the perforating apparatus comprising:

a generally tubular gun carrier;

a charge tube rotatably mounted within the gun carrier, the charge tube including a plurality of circumferentially extending slots;

at least one shaped charge mounted in the charge tube and operable to perforate the well upon detonation; and a dynamically adjustable weight system coupled to the charge tube, the dynamically adjustable weight system including a plurality of discrete weights that are coupled to the charge tube at the slots, such that the circumferential location of the weights is adjustable along the length of the slots to adjust the center of gravity of the charge tube such that gravity will cause the charge tube to rotate within the gun carrier to position the at least one shaped charge in a desired circumferential direction relative to the well prior to perforating.

6. The perforating apparatus as recited in claim 5 wherein the slots extend circumferentially between about 90 and 180 degrees.

7. The perforating apparatus as recited in claim 5 wherein adjacent slots extend in circumferentially opposite directions.

8. The perforating apparatus as recited in claim 5 wherein the weights are attached to the charge tube using bolts that are selectively slidable within the slots.

9. The perforating apparatus as recited in claim 5 wherein the at least one shaped charge further comprises a plurality of shaped charges and wherein each of the shaped charges is positioned in the charge holder to fire in substantially the same circumferential direction.

10. The perforating apparatus as recited in claim 5 wherein the at least one shaped charge further comprises a plurality of shaped charges and wherein the shaped charges are positioned in the charge holder to fire in multiple circumferential directions.

11. A method of perforating a subterranean well comprising the steps of:

identifying at least one undesired circumferential direction associated with a perforating interval in the well;

adjusting components of a dynamically adjustable weight system to change the center of gravity of a charge holder rotatably mounted within a gun carrier by relocating discrete weights circumferentially about the charge holder relative to circumferentially extending slots in the charge holder;

positioning the gun carrier within the perforating interval in the well;

gravitationally aligning at least one shaped charge mounted in the charge holder in at least one desired circumferential direction relative to the well that does not correspond with the at least one undesired circumferential direction; and firing the at least one shaped charge to perforate the well in the at least one desired circumferential direction.

12. The method as recited in claim 11 wherein firing the at least one shaped charge to perforate the well in the at least one desired circumferential direction further comprises firing a plurality of shaped charges in substantially the same circumferential direction.

13. The method as recited in claim 11 wherein firing the at least one shaped charge to perforate the well in the at least one desired circumferential direction further comprises firing a plurality of shaped charges in multiple circumferential directions.

* * * * *